United States Patent [19]

Myogadani

[11] Patent Number: 5,001,952

[45] Date of Patent: Mar. 26, 1991

[54] ROTARY CUTTER

[75] Inventor: Shigeharu Myogadani, Nishinomiya, Japan

[73] Assignee: Kanzaki Paper Manufacturing Co., Ltd., Tokyo, Japan

[21] Appl. No.: 442,074

[22] Filed: Nov. 28, 1989

[30] Foreign Application Priority Data

Nov. 30, 1988 [JP] Japan ..... 63-156181[U]

[51] Int. Cl.[5] ..... B26D 1/38

[52] U.S. Cl. ..... 83/342; 83/349

[58] Field of Search ..... 83/349, 342, 346, 341

[56] References Cited

U.S. PATENT DOCUMENTS

| | | | |
|---|---|---|---|
| 2,805,715 | 9/1957 | Novick | 83/349 |
| 3,552,251 | 1/1971 | Neff et al. | 83/299 |
| 3,650,171 | 3/1972 | Reed | 83/355 |
| 3,822,265 | 7/1974 | Obenshain | 83/342 |
| 4,119,003 | 10/1978 | Corse | 83/341 |
| 4,572,686 | 2/1986 | Tanaka | 400/621.1 |

*Primary Examiner*—Hien H. Phan

*Assistant Examiner*—John M. Husar

*Attorney, Agent, or Firm*—Morgan & Finnegan

[57] ABSTRACT

According to the invention, a rotary cutter is provided, which includes a fixed blade having a straight cutting edge and a rotary blade having a spiral cutting edge. The rotary blade is installed for rotation about an axis extending parallel to the cutting edge of the fixed blade, the spiral cutting edge of the rotary blade moving along a path which extends tangentially to said cutting edge of the fixed blade. At least one of the fixed blade and the rotary blade is shorter than the width of a paper strip. Accordingly, the rotary blade and the fixed blade cooperate with each other to partially cut the paper strip widthwise while leaving the opposite end portions uncut. The fixed blade has opposite surfaces extending toward the cutting edge thereof, one of which comprises an inclined surface formed on the paper inlet side of the fixed blade and disposed at an angle less than 60° with respect to the paper strip. Accordingly, the cut strip can get over the fixed blade without being caught thereon immediately after cutting.

3 Claims, 2 Drawing Sheets

Prior Art

ROTARY CUTTER

FIELD OF THE INVENTION

The invention relates to a rotary cutter for partially cutting a paper strip widthwise while leaving the opposite end portions uncut.

PRIOR ART

When producing a number of labels, a pattern is printed on a paper strip at specific lengths. The paper strip is then cut widthwise into the specific lengths to obtain the labels each having the pattern. In such the case, a shearing-type rotary cutter is commonly used to cut the paper strip widthwise. As shown in FIG. 6, the rotary cutter includes a fixed blade 22 having a straight cutting edge 24 and a rotary blade 26 installed for rotation about an axis extending parallel to the cutting edge 24 of the fixed blade 22. In the shearing-type, the rotary blade 26 includes a spiral cutting edge 28 moving along a path which extends tangentially to the cutting edge 24 of the fixed blade 22. Accordingly, the rotary blade 26 and the fixed blade 22 cooperate with each other so that the paper strip 30 is cut widthwise from one end of the cut to the other end in the shearing mode by the spiral cutting edge 28 of the rotary blade 26 when the paper strip 30 is fed continuously between the fixed blade 22 and the rotary blade 26. The paper strip 30 can be fed continuously into the printing station without interruption.

It is also known in the shearing-type rotaty cutter to use the fixed blade 22 and rotary blade 26 at least one of which is shorter than the width of the paper strip 30 to partially cut the paper strip 30 widthwise while leaving the opposite end portions uncut. In this case, the paper strip 30 remains continuous to prevent the labels from dispersion. The labels can be easily separated one by one on occasion.

As to the rotary cutter in the prior art, the fixed blade 22 has opposite surfaces 32 and 34 extending toward the cutting edge 24 thereof. One surface 32 comprises a vertical surface formed on the paper inlet side of the fixed blade 22 and disposed perpendicularly to the paper strip 30. The other surface 34 comprises an inclined surface formed on the paper outlet side of the fixed blade 22 and disposed at an angle less than 90° with respect to the paper strip 30. The rotary blade 26 also has opposite surfaces 36 and 38 extending toward the cutting edge 28 thereof. One surface 36 comprises a vertical surface formed on the rotary leading side of the rotary blade 26 and disposed perpendicularly to the paper strip 30. The other surface 38 comprises an inclined surface formed on the rotary trailing side of the rotary blade 26 and disposed at an angle less than 90° with respect to the paper strip 30.

However, when partially cutting the paper strip 30 widthwise while leaving the opposite end portions uncut in such the rotary cutter, the cut strip 30 is caught on the the vertical surface 32 of the fixed blade 22 on the paper inlet side thereof immediately after cutting. The cut strip 30 is also caught and then pulled by the vertical surface 36 of the rotary blade 26 on the rotary leading side thereof, thus forming breaks (b) at the opposite ends of the cut (c) as shown in FIG. 7. Accordingly, when separating the labels, the paper strip 30 tends to tear from such breaks (b), ruining the labels.

SUMMARY OF THE INVENTION

The object of the invention is to provide a shearing-type rotary cutter in which the paper strip can be partially cut widthwise without forming breaks at the opposite ends of the cut.

According to the invention, in the rotary cutter which includes a fixed blade having a straight cutting edge and a rotary blade having a spiral cutting edge, the fixed blade has opposite surfaces extending toward the cutting edge thereof, one of which comprises an inclined surface formed on the paper inlet side and disposed at an angle less than 60° with respect to the paper strip. Accordingly, the cut strip can get over the fixed blade without being caught thereon immediately after cutting. The breaks are therefore hardly formed at the opposite ends of the cut even if the cut strip is pulled by the rotary blade.

In addition, the rotary blade has opposite surfaces extending toward the cutting edge thereof, one of which comprises an inclined surface formed on the rotary leading side of the rotary blade and disposed at an angle less than 90° with respect to the paper strip. Accordingly, the rotary blade can slip over the cut strip without catching it immediately after cutting so that the cut strip is not pulled by the rotary blade. Accordingly, the breaks are not at all formed at the opposite ends of the cut.

The angle between the inclined surface of the fixed blade and the paper strip may preferably be 45°. The angle between the inclined surface of the rotary blade and the paper strip may preferably be 30°.

The fixed blade and the rotary blade are preferably disposed to be slightly inclined at an angle with respect to a transverse line normal to the feed direction of the paper strip. The angle between the fixed and rotary blades and the transverse line substantially corresponds to the angle of twist of the spiral cutting edge of the rotary blade. Accordingly, the paper strip is cut along the transverse line normal to the feed direction thereof.

A rotary cutter embodying the invention is hereinafter described, by way of example, with reference to the accompanying drawings.

DETAILED DESCRIPTION OF THE PREFERRED EMBODIMENT

Figure 1:
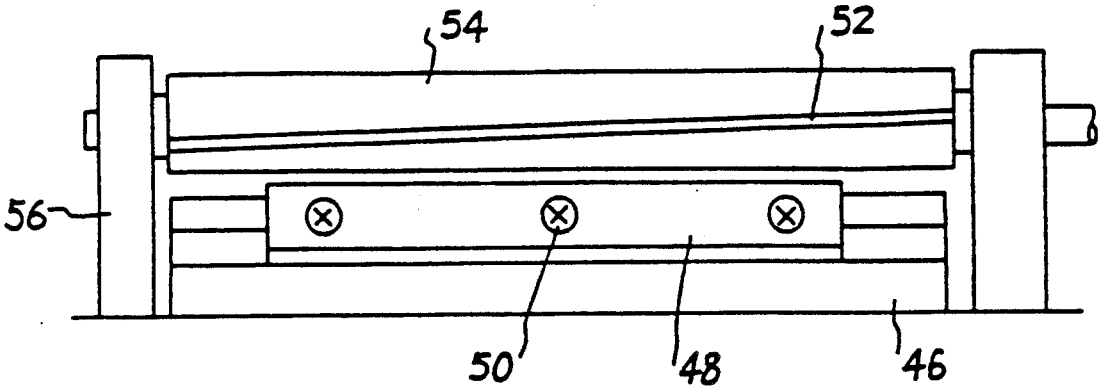
FIG. 1 is a elevational view of a preferred embodiment of the invention.
Figure 2:
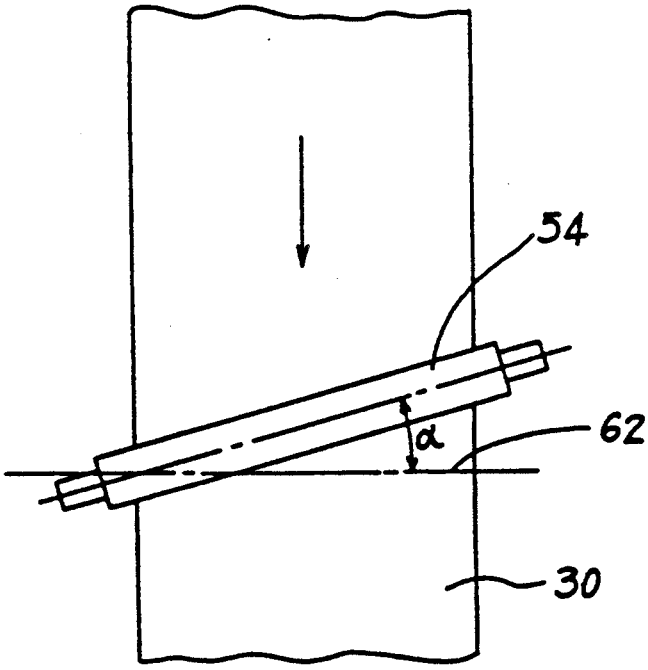
FIG. 2 is a plan view of FIG. 1 embodiment.
Figure 3:
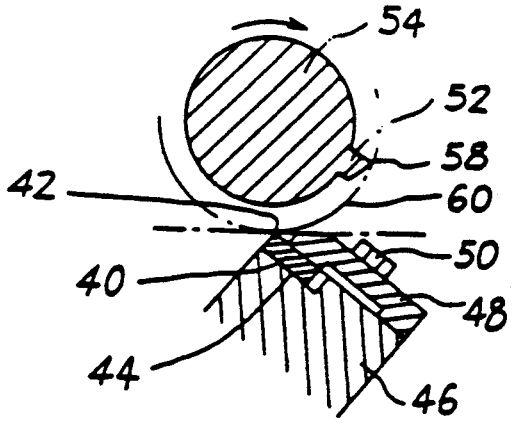
FIG. 3 is a sectional view of FIG. 1 embodiment.

Referring to FIG. 1, a shearing-type rotary cutter according to the invention is shown. The rotary cutter includes a fixed blade 40 having a straight cutting edge 42 as shown in FIG. 3, the fixed blade 40 being received in a recess 44 formed in a block 46. A holder 48 is pressed against the fixed blade 40 by bolts 50 so that the fixed blade 40 is fixedly mounted on the block 46. The rotary cutter also includes a rotary blade 52. The rotary blade 52 is formed spirally on the drum 54 which is mounted on a pair of brackets 56 for rotation about an axis extending parallel to the cutting edge 42 of the fixed blade 40. The drum 54 is operatively connected to the drive motor by means of gears or belts not shown. The rotary blade 52 has a spiral cutting edge 58 moving along a path 60 which extends tangentially to the cutting edge 42 of the fixed blade 40.

In this rotary cutter, a paper strip 30 is fed continuously to the left in FIG. 3 and between the fixed blade 40 and the rotary blade 52. The drum 54 is driven by the moter so that the rotary blade 52 rotates clockwise at a circumferential rate corresponding to or slightly higher than the feed rate of the paper strip 30. Accordingly, the rotary blade 52 and the fixed blade 40 cooperate with each other so that the paper strip 30 is cut widthwise from one end of the cut to the other end in the shearing mode by the spiral cutting edge 58 of the rotary blade 52. This permits cutting of the paper strip 30 into the lengths without interruption of feeding the paper strip 30.

In plan view, the fixed blade 40 and the rotary blade 52 are disposed to be slightly inclined at an angle ($\alpha$) with respect to a transverse line 62 normal to the feed direction of the paper strip 30. The angle ($\alpha$) between the fixed and rotary blades 40 and 52 and the transverse line 62 substantially corresponds to the angle of twist of the spiral cutting edge 58 of the rotary blade 52. Accordingly, the paper strip 30 can be cut along the transverse line 62 normal to the feed direction thereof in spite of the shearing mode. In addition, at least one of the fixed blade 40 and the rotary blade 52 is shorter than the width of the paper strip 30. In this embodiment, the fixed blade 40 is shorter than the width of the paper strip 30 while the rotary blade 52 is longer than the width of the paper strip 30. Accordingly, the paper strip 30 is partially cut widthwise while leaving the opposite end portions uncut so that it remains continuous.

Figure 4:
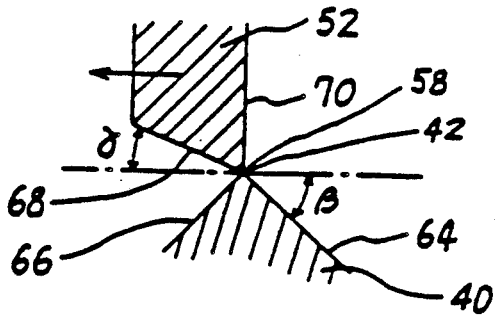
FIG. 4 is a sectional view, on an enlarged scale, of a fixed blade and a rotary blade in FIG. 3.

In this rotary cutter, the fixed blade 40 has opposite surfaces 64 and 66 extending toward the cutting edge 42 thereof as shown in FIG. 4. One surface 64 comprises an inclined surface formed on the paper inlet side of the fixed blade 40 and disposed at an angle ($\beta$) less than 60° with respect to the paper strip 30. The angle ($\beta$) between the inclined surface 64 of the fixed blade 40 and the paper strip 30 is 45°. In this embodiment, the other surface 66 also comprises an inclined surface formed at the paper outlet side of the fixed blade 40 and disposed at an angle less than 90° with respect to the paper strip 30. The rotary blade 52 has opposite surfaces 68 and 70 extending toward the cutting edge 58 thereof. One surface 68 comprises an inclined surface formed on the rotary leading side of the rotary blade 52 and disposed at an angle ($\gamma$) less than 90° with respect to the paper strip 30. The angle ($\gamma$) between the inclined surface 68 of the rotary blade 52 and the paper strip 30 is 30°. The other surface 70 comprises a vertical surface formed on the rotary trailing side of the rotary blade 52 and disposed perpendicularly to the paper strip 30.

Figure 5:
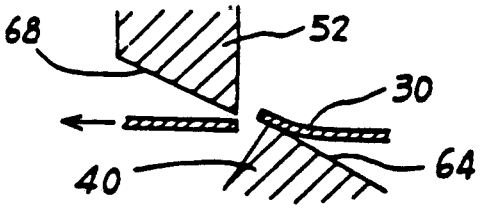
FIG. 5 is a sectional view, on an enlarged scale, showing the fixed blade and the rotary blade in FIG. 3 and a paper strip immediately after cutting.
Figure 6:
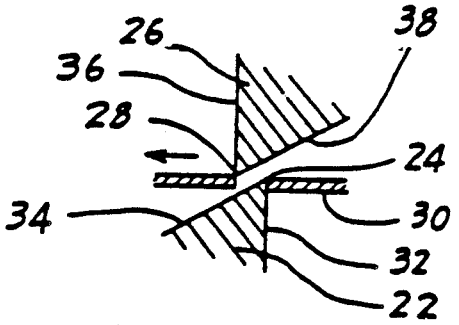
FIG. 6 is a sectional view, on an enlarged scale, of a rotary cutter in the prior art and a paper strip immediately after cut in comparison with those in FIG. 5.
Figure 7:
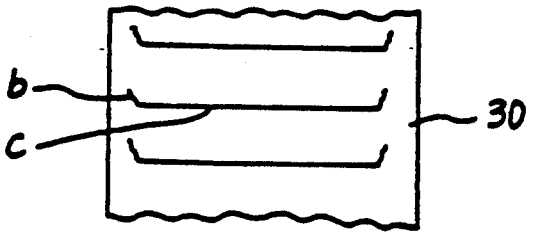
Prior Art Fig. 7
FIG. 7 is a plan view of a paper strip cut widthwise by the rotary cutter in the prior art.

Accordingly, when partially cutting the paper strip 30 widthwise while leaving the opposite end portions uncut, the cut strip 30 moves along the inclined surface 64 of the fixed blade 40 to get over the fixed blade 40 without being caught thereon immediately after cutting as shown in FIG. 5. Unlike the paper strip 30 in the prior art shown in FIG. 7, the breaks (b) are therefore hardly formed at the opposite ends of the cut (c). In addition, even if the rotary blade 52 rotates at a circumferential rate slightly higher than the feed rate of the paper strip 30, the cut strip 30 is pushed down by the inclined surface 68 of the rotary blade 52 so that the rotary blade 52 can slip over the cut strip 30 without catching it immediately after cutting. The cut strip 30 is not therefore pulled by the rotary blade 52. Accordingly, the breaks (b) are not at all formed at the opposite ends of the cut (c).

What is claimed is:

1. A rotary cutter including a fixed blade having a straight cutting edge, and a rotary blade installed for rotation about an axis extending parallel to said cutting edge of the fixed blade, said rotary blade including a spiral cutting edge moving along a path which extends tangentially to said cutting edge of the fixed blade, at least one of said fixed blade and said rotary blade being shorter than the width of a paper strip so that said rotary blade and said fixed blade cooperate with each other to partially cut the paper strip widthwise while leaving the opposite end portions uncut, said rotary cutter being characterized in that said fixed blade having opposite surfaces extending toward said cutting edge thereof, one of which comprises an inclined surface formed on the paper inlet side of said fixed blade and disposed at an angle less than 60° with respect to said paper strip whereby the cut strip can get over said fixed blade without being caught thereon immediately after cutting, and said rotary blade having opposite surfaces extending toward said cutting edge, one of which comprises an inclined surface formed on the rotary leading side of said rotary blade and disposed at an angle less than 90° with respect to said paper strip whereby said rotary blade can slip over the cut strip without catching it immediately after cutting.

2. A rotary cutter of claim 1, wherein said angle between said inclined surface of the fixed blade and said paper strip is 45°, said angle between said inclined surface of the rotary blade and said paper strip being 30°.

3. A rotary cutter of claim 2, wherein said fixed blade and said rotary blade are disposed to be slightly inclined at a angle with respect to a transverse line normal to the feed direction of the paper strip, said angle between said fixed and rotary blades and said transverse line substantially corresponding to the angle of twist of the spiral cutting edge of said rotary blade so that the paper strip is cut along said transverse line normal to the feed direction thereof.

* * * * *